US006453978B1

(12) United States Patent
Grolla

(10) Patent No.: US 6,453,978 B1
(45) Date of Patent: Sep. 24, 2002

(54) METHOD AND AN APPARATUS FOR FILLING OF MOLDS WITH LIQUIDY METALS

(75) Inventor: Herbert Grolla, Bad Laasphe (DE)

(73) Assignee: Heinrich Wagner Sinto Maschinenfabrik GmbH, Bad Laasphe (DE)

( * ) Notice: Subject to any disclaimer, the term of this patent is extended or adjusted under 35 U.S.C. 154(b) by 0 days.

(21) Appl. No.: 10/003,542

(22) Filed: Nov. 2, 2001

Related U.S. Application Data

(62) Division of application No. 09/553,819, filed on Apr. 21, 2000.

(51) Int. Cl.[7] ..... B22D 18/00; B22D 37/00

(52) U.S. Cl. ..... 164/119; 164/133; 164/136

(58) Field of Search ..... 164/133, 136, 164/335, 329, 322, 119, 306

(56) References Cited

U.S. PATENT DOCUMENTS 3,343,591 A * 9/1967 Lorang ..... 164/155.2
3,472,942 A * 10/1969 Campbell ..... 164/335
3,807,484 A * 4/1974 von Starck ..... 164/133
3,996,996 A * 12/1976 Gunnergaard ..... 164/130
4,113,001 A * 9/1978 Workman ..... 164/255
4,753,283 A * 6/1988 Nakano ..... 164/312
4,977,946 A * 12/1990 Borrousch et al. ..... 164/130
5,125,450 A * 6/1992 Kidd et al. ..... 164/113
5,465,777 A * 11/1995 Brunner ..... 164/136
5,636,680 A * 6/1997 Mogensen et al. ..... 164/119

FOREIGN PATENT DOCUMENTS

EP 0 894 557 A * 2/1999

* cited by examiner

*Primary Examiner*—M. Alexandra Elve
*Assistant Examiner*—Len Tran
(74) *Attorney, Agent, or Firm*—Flynn, Thiel, Boutell & Tanis, P.C.

(57) ABSTRACT

A casting process for casting, in particular of sand molds provided with casting boxes, which makes it possible to keep the apparatus expense low, to save cycle material and to achieve an improved quality, consists of the intake channel extending in a plane lying essentially horizontally during casting and being provided with a bearing surface defining its port, onto which bearing surface can be sealingly positioned a fill pipeline through which the mold can be filled with metal under low pressure. A casting system to carry out the method consists of a casting machine with a pressure kettle and a fill pipeline which is connected to the intake channel lying essentially in a horizontal plane, whereby the sealed coupling of fill pipeline and intake channel is obtained through specified bearing pressure.

13 Claims, 4 Drawing Sheets

METHOD AND AN APPARATUS FOR FILLING OF MOLDS WITH LIQUIDY METALS

This is a division of U.S. Pat. Ser. No. 09/553,819, filed Apr. 21, 2000.

FIELD OF THE INVENTION

The invention relates to a method for filling of a mold and a casting system, whereby in particular a sand mold having a casting box with an upper and a lower mold half is used, and the mold has an intake channel connected in the dividing plane of both mold halves to the mold cavity. The method can be utilized for the filling of both a mold without a box and also a mold provided with a casting box, which can be chemically bound and also clay-bound.

BACKGROUND OF THE INVENTION

Clay-bound sand molds are considerable less expensive than chemically bound molds so that preferably clay-bound sand molds are used in foundries. These clay-bound sand molds are as a rule manufactured in a casting box, which receives each a mold half. It is here known to construct the intake channel in the upper mold half, whereby the casting of the sand mold is particularly simple in constructional respects since the liquidy metal must merely be poured from an open casting pan into the mold. The intake channel extends hereby advantageously over the height of the mold so that the mold cavity is filled in a rising casting. Such a casting of the mold, however, has the significant disadvantage that the metal is poured into the mold from a certain height causing on the one hand a bothersome splattered iron leading to considerable breakdowns in automatically operating mold and casting systems. On the other hand, the unavoidably great casting height causes in these cases high ferro-static pressures in the sand molds, which can deform the sand molds and can also damage them due to turbulences created during the casting. These disadvantages occur also in upright positioned molds, in which the intake channel is either arranged in the mold-dividing plane of both molds or, however, on the upper side of the upper mold half.

For this reason it is already known to fill the molds from the underside, for example, by means of a low-pressure furnace, which has an uptake connected to the port of the intake channel. By increasing the pressure in the gas chamber of the low pressure furnace, the liquidy material is pressed through the uptake upwardly into the mold. The pressure must be maintained until the liquidy or molten material in the intake channel of the mold has solidified. The pressure in the low-pressure furnace is subsequently lowered and the still liquidy excessive material flows back into the low-pressure furnace. The mold can then be lifted off and moved on. Such a method has proven to be successful, however, it requires an expensive apparatus, especially since the positioning of the mold above the uptake and the recharging of the low-pressure furnaces demand a high degree of technology. These devices are also technically complicated since the mechanical parts lying below the plane of the mold are difficult to access and are thus difficult to service.

SUMMARY OF THE INVENTION

The basic purpose of the invention is to provide a method and an apparatus to carry out the method and a suitable mold, which make it possible to keep down the level of technology and thus the investment expenses accordingly, which demand little service while at the same time providing high process safety and a precise repetitive exactness and significantly reduce the amount of the cycle material, save energy, avoid smoke development, eliminate a penetration formation caused by the height of casting, and moreover guarantee a calm, turbulence-free mold filling. A further purpose of the invention is to provide the casting system in such a manner that also existing casting systems can be retrofitted in a simple and inexpensive manner so that the method of the invention can be carried out with these casting systems.

This purpose is attained according to the invention for the method in such a manner that the intake channel is arranged extending in a plane lying essentially horizontally during casting, and has a bearing surface defining its port, onto which bearing surface can be sealingly placed a fill pipeline, through which the mold can be filled with liquidy metal under low pressure.

Thus a mold is used for the method of the invention which is divided in two, whereby the intake channel extends essentially in the dividing plane, whereby the mold is arranged in such a manner during casting that the dividing plane lies essentially horizontally. It may be advantageous for certain mold cavity designs to slightly incline the mold with respect to the horizontal in order to achieve a calm and even filling of the entire mold cavity. The intake channel of the mold is designed in such a manner that a bearing surface for a fill pipe is constructed around its port, which fill pipe can be sealingly fitted to this bearing surface. It has hereby been determined that also in the case of clay-bound sand molds a flat bearing surface is already sufficient when same rests under a certain pressure on the port of the fill pipe in order to guarantee a metal-tight seal. The mold cavity can then be filled with a relatively small overpressure through the fill pipeline through the horizontally lying intake channel, whereby it has here been found to be advantageous when the fill pipeline is connected to a casting machine and terminates in the lower part of a pressure chamber. A fill chute can also terminate in this lower part of the chamber, the fill funnel of which fill chute must not be closed off when same lies above the maximum fill level of the pressure kettle. Such a casting machine makes it possible, corresponding with the respective requirements, to successively increase the fill pressure in the pressure kettle by increasing the pressure so that the mold cavity can be filled without any danger of penetration and free of turbulence. Two or more fill pipelines can be connected to a casting machine so that several molds can be filled simultaneously.

It has proven to be advantageous when the mold is moved toward the opening of the fill pipeline, whereby here a specified bearing pressure is adjusted, for example, by means of a moving cylinder. The casting boxes are supplied on a conventional floor-mounted conveyer with the mold-dividing plane lying horizontally, on which floor-mounted conveyer the casting boxes are cyclically moved. A moving device is integrated into this floor-mounted conveyer, whereby one or more casting boxes are arranged simultaneously laterally movably so that they can be moved toward the mouthpiece of the casting machine in order to fill the mold. After the mold has been filed, the casting boxes are moved back to the floor-mounted conveyor by the moving device and are moved on cyclically. The force with which the moving device is moved toward the casting machine is adjustable so that the bearing pressure of the bearing surface of the mold at the port of the fill pipeline can be adapted to the respective requirements.

Immediately after the mold has been filled, the intake channel is closed off by means of moving sand or core, whereby this sand or rather core movement is caused by a ram which presses sand into the cross section of the intake channel or, however, moves a core into said channel. Thus one must not wait here until the metal solidifies in the intake channel but the separation of the mold from the fill pipeline can occur directly after the intake channel has been closed off. This results in a significant decrease in the cycle time.

A filter is installed, according to a further suggestion of the invention, into the intake channel of the mold, namely in flow direction in front of the point at which the intake channel is closed off by sand or core movement, which filter prevents sand parts, which could come loose during closing, from reaching into the fill pipeline.

The casting system, to carry out the method of the invention, consists of a transport device for supplying and removing the casting boxes, a casting machine for filling the casting boxes, and a blocking device to block the intake channel of the mold following the casting, whereby the transport device houses a moving carriage, by means of which the casting box can be moved transversely with respect to the transport direction of the transport path toward the casting machine and back to the transport path, whereby through the movement of the casting box same can be moved closely toward an opening of a fill pipeline of the casting machine, and the metal can be pressed by means of the overpressure in the casting machine into the mold cavity of the mold.

The casting machine is advantageously one which has a pressure kettle, in the lower area of which terminate both the fill pipeline and also a fill chute, through which material follows into the casting machine. The pressure kettle is closed off and is connected to a pressure-gas system so that upon an increase of the pressure in the pressure kettle the material in the fill pipeline and also in the fill chute increases. Since the fill chute has a fill funnel, which lies above the maximum level of the fill level of the pressure kettle and also above the port of the fill pipeline, it is possible to recharge the casting machine at any time.

The intake channel lies in the mold in the mold-dividing plane of the upper and lower box, whereby here a recess exists in the casting box so that a bearing surface is here opened up directly in the mold. The recess is advantageously conical so that the guiding of the port of the head channel of the fill pipeline is made easier.

Because of the very sensitive dosable fill speed of the mold cavity, same can be designed without any kind of a vent bore so that the necessary finish work on the cast pieces and the cycle material are further reduced.

Based on the method of the invention a casting system is provided which requires only a low level of technology and thus also little investment expenses. Such a casting system demands less service also because expensive dosing mechanisms are not needed. This means that an improvement of the availability of the system exists. Since we are here dealing with a closed fill system, also the heat loss is very low, thus resulting in a significant energy savings and moreover also a smoke development is avoided so that all in all better environmental conditions at the work station exist. Moreover, because of the closed system splattered iron also does not accumulate. Since dosing based on the low need for pressure for filling of the mold can be reached very exactly and reproducibly by simple means, a high process safety and a precise repetitive exactness is obtained. Moreover, the system makes it possible to store data so that the fill curves for each mold filling can be documented. Moreover, the system of the invention reduces the required cycle material, and penetration formations in the mold do not exist since here an energy entry caused by the casting height is avoided. Moreover, a very calm and turbulence-free mold filling is obtained. It is also advantageous that existing casting systems can be retrofitted for the new method with relatively little expense.

BRIEF DESCRIPTION OF THE DRAWINGS

One exemplary embodiment of the invention will be described in greater detail hereinafter in connection with the drawings, in which.

DETAILED DESCRIPTION

Figure 1:
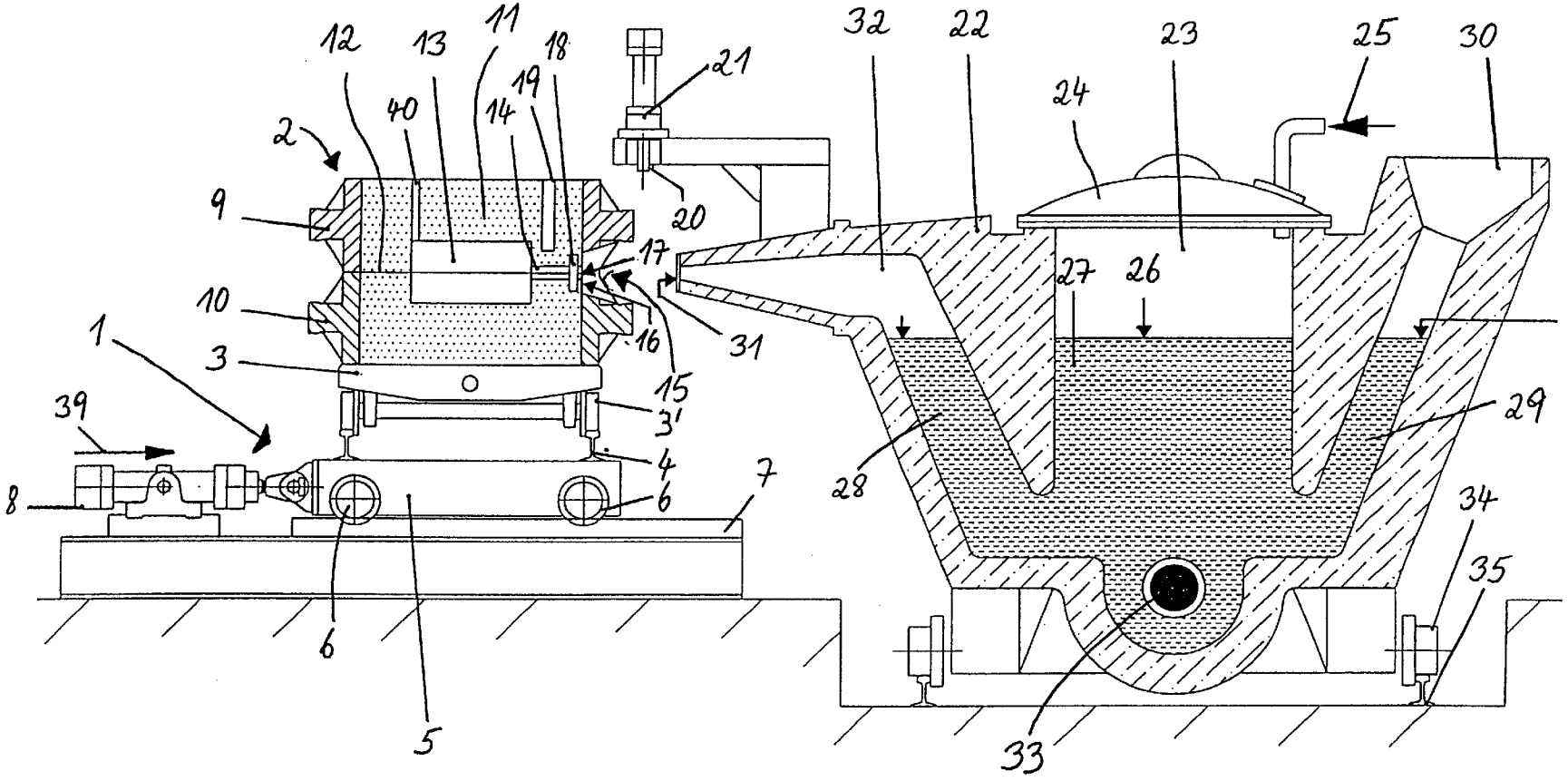
FIG. 1 is a side view of a casting system of the invention, partially in cross section.

Reference numeral 1 in the drawings identifies a floor-mounted conveyor on which the casting boxes 2 are transported by means of a transport carriage 3'. The transport carriage 3 moves with its wheels 3 on rails 4, a section of the rails 4 is arranged on a moving carriage 5, which in turn has wheels 6 which run on rails 7 extending transversely with respect to the rails 4 of the floor-mounted conveyor 1. The moving carriage 5 is driven by a double-acting piston-cylinder unit 8.

The casting box 2 consists of an upper box 9 and a lower box 10, which together receive the mold 11. The mold-dividing plane 12 is aligned horizontally in the exemplary embodiment according to FIG. 1. The illustrated mold 11 is a clay-bound sand mold having a mold cavity 13, connected to an intake channel 14, which ends in the mold-dividing plane 12. The upper and lower boxes 9, 10 have for this purpose a recess 15 which is designed conically and defines a bearing surface 16 surrounding the opening 17 of the intake channel 14.

A filter 18 is inserted into the intake channel 14 just before its end, which filter prevents sand particles of the mold from exiting through the opening 17 of the intake channel 14.

A channel 19 is formed into the upper half of the mold 11, which channel ends a short distance from the intake channel 14. A ram 20 of a blocking cylinder 21 can be introduced into this channel, which ram moves the sand between the end of the channel 19 and the intake channel 14 in such a manner that said sand closes off the intake channel 14.

Reference numeral 22 identifies a casting machine which has a pressure kettle 23 closed off with a lid 24. The lid has a pressure-gas connection 25, through which pressurized gas can be introduced into the space above the bath level 26 of the molten metal 27.

The pressure kettle is connected at one side of the lower area to a fill pipeline 28 and at the other side to a fill chute 29. The fill chute 29 terminates in a fill funnel 30, the opening of which ends both above the pressure kettle 23 and also above the port 31 of the fill pipeline 28. The fill pipeline 28 is essentially horizontally designed in its upper part and ends here in a head channel 32 which is closed off on all sides. The head channel can have a closable opening in order to be able to clean same better when needed.

The casting machine 22 has an induction heating system 33, with which the melt 27 is maintained at the casting temperature. The casting machine 22 has wheels 34 which run on rails 35 so that the casting machine can, if necessary, also be moved to a refill oven. On the other hand, it is also possible to fill the casting machine on site with the help of a pan.

Figure 2:
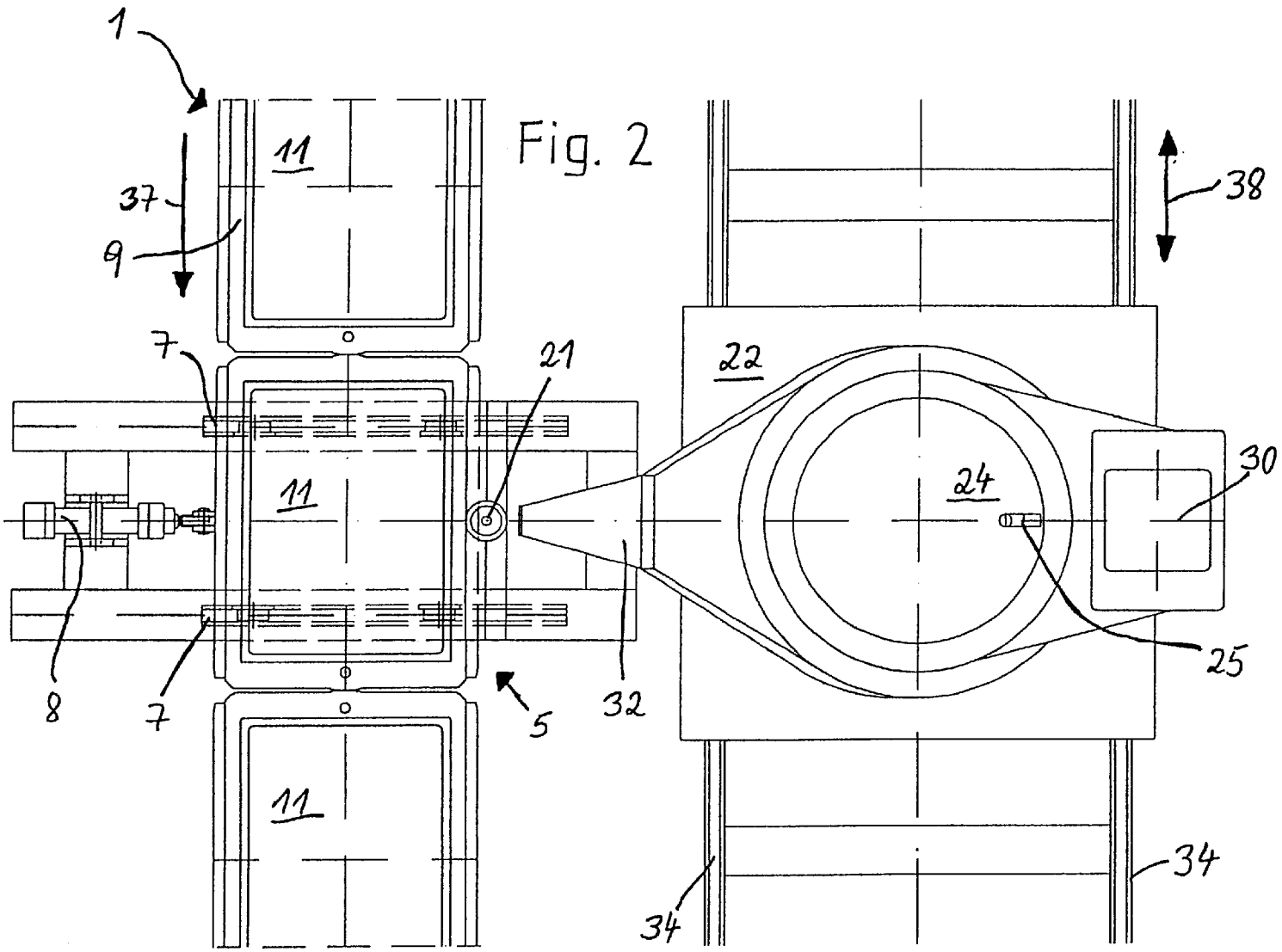
FIG. 2 is a top view of the casting system according to FIG. 1.

The casting system of the invention operates as follows:

The molds are supplied together with their casting boxes on the floor-mounted conveyor 1 in direction of the arrow 37 (FIG. 2) and move in cycles with their transport carriage 3 onto the moving carriage 5. The moving carriage 5 is then moved by means of the piston-cylinder unit 8 in direction of the arrow 39 until the port 31 of the fill pipeline 28 rests on the bearing surface 16 of the mold 11. The piston-cylinder unit 8 is thereby loaded with such a pressure that a specified bearing pressure between the port 31 and the bearing surface 16 occurs. Pressurized gas is thereafter blown through the pressure-gas connection 25 into the pressure kettle 23 until the level of the molten metal in the fill pipeline 28 runs through the port 31 into the intake channel 14 of the mold 11. The pressure is hereafter still further increased until the specified fill pressure for the mold 11 is obtained. This pressure is maintained over the entire fill time of the mold cavity 13 of the mold 11, whereby it is also possible to provide a specific pressure profile in dependency of the mold cavity 13.

In the here illustrated embodiment of the mold 11, same has a vent channel 40, through which the gas contained in the mold cavity can escape. However, this vent channel is not absolutely necessary and it can be deleted when the mold as such is sufficiently gas-permeable for the filling process. This has the advantage that on the one hand subsequent work to remove the metal accumulating in the vent channel is not needed and on the other hand also the material cycle is further reduced.

After the mold has been filled, the ram 20 is moved into the channel 19 by means of the blocking cylinder 21, whereby the sand is hereby shifted in such a manner that same closes off the intake channel 14. After the ram 20 has been moved out of the channel 19, the casting box with the mold 11 can be moved back directly into its initial position so that via a cyclical operation a further casting box with a new mold 11 can be positioned on the moving carriage 5. The described casting operation is then repeated.

Figure 3:
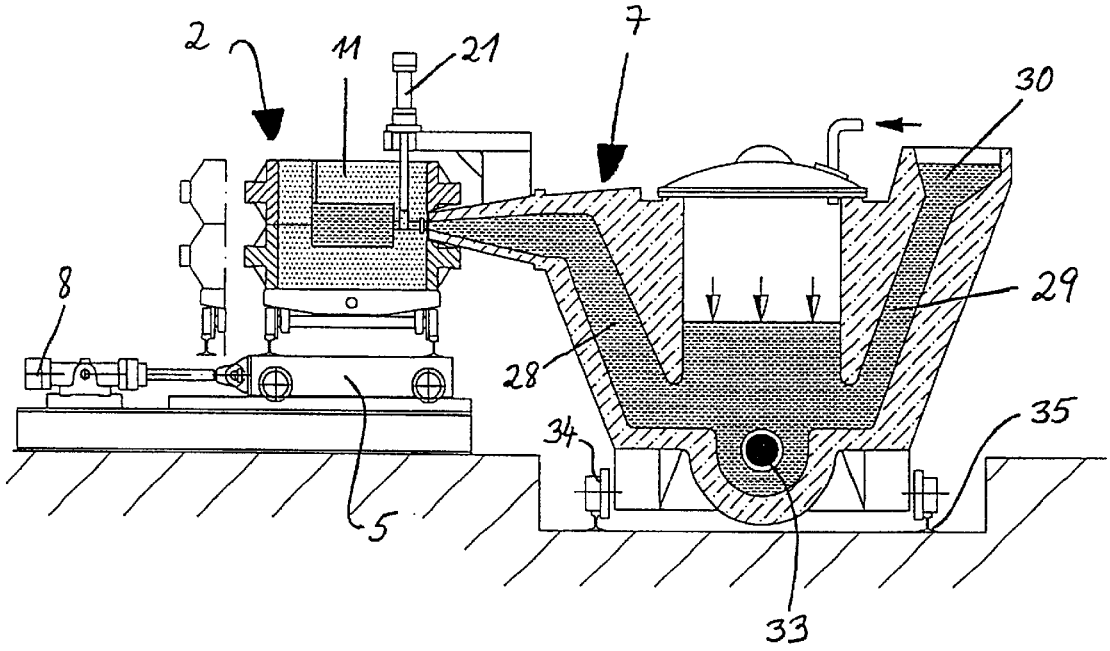
FIG. 3 illustrates the casting system illustrated in FIG. 1 during the mold filling.
Figure 4:
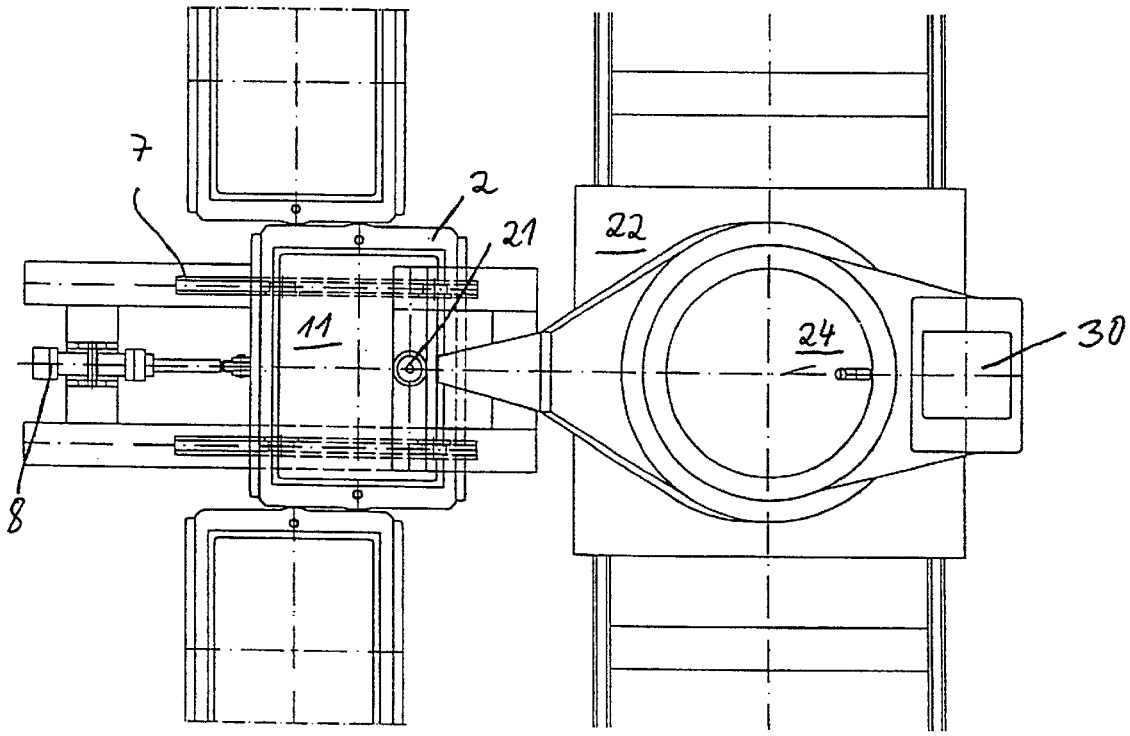
FIG. 4 is a top view of the casting system according to FIG. 3, FIGS. 5 and 6 illustrate the casting system according to the invention corresponding to FIGS. 3 and 4, however, with the mold being inclined with respect to the horizontal during casting.
Figure 5:
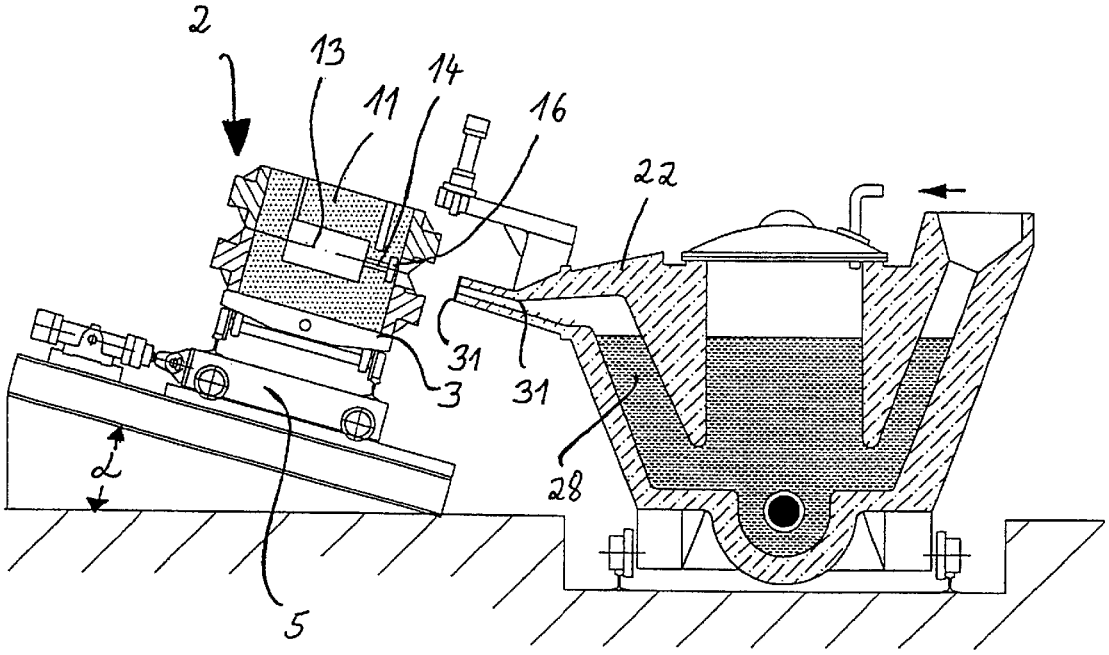
Figure 6:
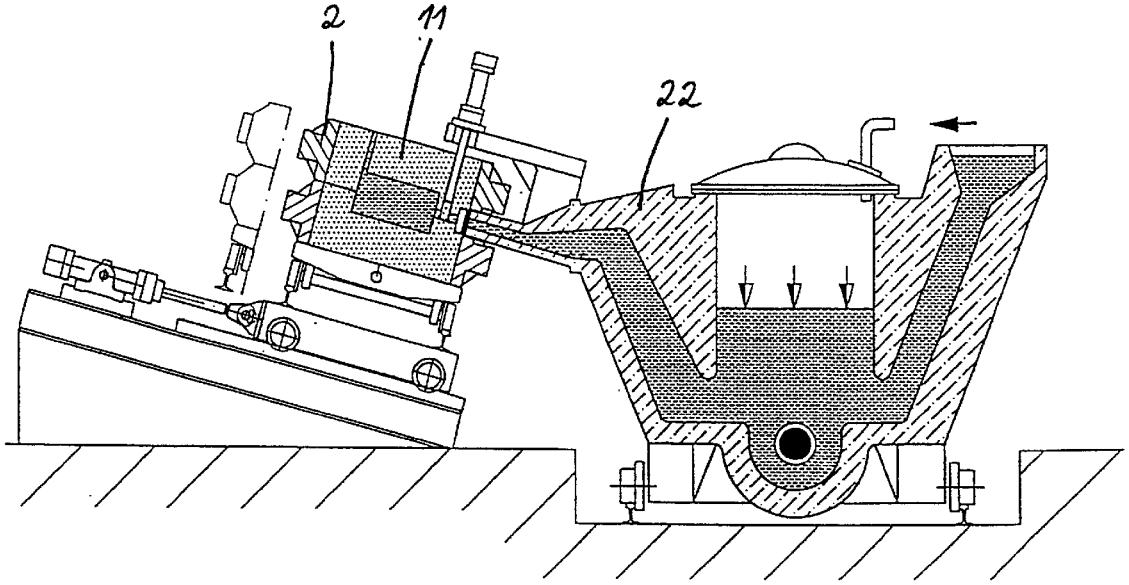

FIG. 3 illustrates the aforedescribed filling process and the casting box with the mold 11 moved into the filling position. FIG. 3 shows how the increased pressure acts in the pressure kettle 23, whereby said pressure can be increased to the level permitted by the fill funnel 30 of the fill chute 29. The exemplary embodiment illustrated in FIGS. 5 and 6 differs from the one in the proceeding figure merely in the mold 11 including the casting box 2, the transport carriage 3 and the moving carriage 5 having been tilted at an angle a with respect to the horizontal. This also assumes that the head channel 32 of the fill pipeline 28 is designed correspondingly inclined so that the port 31 of the fill pipeline 28 securely abuts the bearing surface 16 of the intake channel 14. This inclined arrangement of the casting box 2 and of the mold 11 can be advantageous for filling of molds with complicated mold cavities 13. FIG. 6 illustrates the casting box 2 with the mold 11, which casting box is in comparison to FIG. 5 moved toward the casting machine 22, and the bath level within the casting machine 22 having been lowered by the amount required to fill the mold.

What is claimed is:

1. A method for filling of a mold consisting of lower and upper parts each having an internal mold cavity separated by a generally horizontally oriented mold-dividing plane and an intake channel extending in and along the mold-dividing plane to provide a generally horizontally facing inlet port to the mold cavity, and a casting machine having a generally horizontally facing outlet port through which molten metal flows for facilitating a filling of the mold cavity, comprising the steps of:

moving the mold and the inlet port thereof laterally toward and into a sealingly coupled relation to the outlet port of the casting machine;

causing molten metal in the casting machine to flow through the outlet port into the inlet port and thence into the mold cavity of the mold.

2. The method according to claim 1, wherein the moving step includes the step of inclining the mold slightly with respect to the horizontal.

3. The method according to claim 1, wherein the upper and lower parts of the mold each are made of sand and have a recess at a bottom of which is defined the inlet port, and wherein the moving step includes the step of moving the outlet port into the recess.

4. The method according to claim 1, wherein the casting machine has a pressure kettle receiving the metal to be cast, into the lower area of which pressure kettle terminates lower ends of a fill chute and a fill pipeline coupled at an upper end thereof to the horizontally facing outlet port, and wherein the fill chute has a fill funnel which projects above the fill level of the pressure kettle and the outlet port, and wherein the step of causing molten metal in the casting machine to flow is achieved by pressurizing the pressure kettle.

5. The method according to claim 1, wherein after the filling of the mold has taken place the intake channel is mechanically closed off and the mold is returned into its initial position.

6. The method according to claim 5, wherein the intake channel is closed off by sand/core movement.

7. The method according to claim 1, wherein the lower and upper mold parts are supplied on a floor-mounted conveyor, wherein a moving device is integrated into the floor-mounted conveyor and wherein the moving step includes a moving of the moving device toward the casting machine to bring the inlet and outlet ports into the coupled relation.

8. The method according to claim 7, wherein the inlet port on the molds are pressed with a specifiable force against the outlet port.

9. The method according to claim 1, wherein the head-piece of the fill pipeline can be changed.

10. The method according to claim 1, including the step of filtering the molten metal thereby preventing the flowing back of sand particles from the intake channel.

11. The method according to claim 1, including the step of making the lower and upper mold parts of a gas-permeable sand, and causing the cavity of the mold to be closed completely but for the intake channel.

12. The method according to claim 1, wherein several molds are filled simultaneously.

13. The method according to claim 1, wherein the pressure in the casting machine is varied during the casting corresponding with the geometry of the mold cavity.

* * * * *